US006357190B1

(12) United States Patent
Florentine

(10) Patent No.: US 6,357,190 B1
(45) Date of Patent: Mar. 19, 2002

(54) WALL BRACING METHOD AND SYSTEM THEREFOR

(76) Inventor: Frank R. Florentine, 1035 Greenview Dr., Crown Point, Lake County, IN (US) 46307

( * ) Notice: Subject to any disclaimer, the term of this patent is extended or adjusted under 35 U.S.C. 154(b) by 0 days.

(21) Appl. No.: 09/690,644

(22) Filed: Oct. 17, 2000

Related U.S. Application Data

(60) Provisional application No. 60/170,431, filed on Dec. 13, 1999.

(51) Int. Cl.[7] ..... E02D 35/00; E02D 37/00

(52) U.S. Cl. ..... 52/293.2; 52/291; 52/126.3; 52/127.2; 52/514; 52/745.09; 52/741.13; 248/351

(58) Field of Search ..... 52/741.13, 745.09, 52/293.2, 293.3, 126.3, 127.2, 291, 169.1, 514, 698; 248/351, 354.3, 357; 254/100

(56) References Cited

U.S. PATENT DOCUMENTS

| | | | | | |
|---|---|---|---|---|---|
| 377,940 | A | * | 2/1888 | Hevner | 52/745.09 |
| 3,537,220 | A | * | 11/1970 | Ellis | 52/293.2 X |
| 4,068,427 | A | * | 1/1978 | Camardo | 52/127.2 |
| 4,353,194 | A | * | 10/1982 | Norton | 52/741.13 |
| 4,757,651 | A | * | 7/1988 | Crites | 52/293.2 X |
| 4,763,878 | A | | 8/1988 | Abraham et al. | |
| 5,845,450 | A | | 12/1998 | Larsen | |

* cited by examiner

*Primary Examiner*—Laura A. Callo
(74) *Attorney, Agent, or Firm*—Gary M. Hartman; Domenica N. S. Hartman

(57) ABSTRACT

A wall bracing system that uses a beam capable of bending to conform to a partially-buckled masonry wall that has buckled inward from external forces, such as hydrostatic pressures to which basement walls are typically exposed. The bracing beam is sufficiently flexible to conform to the partially-buckled wall, enabling the bracing system to apply a relatively uniform pressure against the wall to prevent further inward movement. One end of the beam is secured to the basement floor adjacent the wall, generally not more than the distance the wall has bowed inward, i.e., the horizontal displacement of the primary fracture point of the wall. The upper end of the beam is held in place with a bracket system secured to one or more overhead floor joists. The bracket system applies a force against the upper end of the beam toward the wall. Sufficient pressure is applied against the beam so that at least the upper end of the beam contacts and conforms to the buckled portion of the wall. As a result, the beam is prestressed when installed, making positive contact with at least the portion of the wall above its primary fracture point. Once installed, the prestressed beam moves with the seasonal movement of the wall as temperature and moisture changes occur, while preventing further buckling of the wall.

25 Claims, 3 Drawing Sheets

WALL BRACING METHOD AND SYSTEM THEREFOR

CROSS REFERENCE TO RELATED APPLICATIONS

This application claims the benefit of U.S. Provisional Application No. 60/170,431, filed Dec. 13, 1999.

BACKGROUND OF THE INVENTION

1. Field of the Invention

The present invention generally relates to wall bracing systems. More particularly, this invention relates to a method and apparatus for bracing a wall that has begun to buckle inward as a result of hydrostatic pressure and/or other external forces as may occur with the foundation or basement walls of a building.

2. Description of the Prior Art

Various wall bracing systems are known, as evidenced by U.S. Pat. Nos. 377,940, 4,189,891, 4,353,194 and 5,845,450. The latter patent, U.S. Pat. No. 5,845,450 to Larsen, employs a rigid I-beam that is placed flush against a masonry basement wall and secured at its upper end with threaded rods welded to a bracket fastened to a single floor joist. If the joist runs perpendicular to the wall, the rods are cantilevered from the joist by the bracket. With the rods, a force is applied by the I-beam to the wall. Larsen's bracing system relies on the inherent rigidity of the I-beam to provide a sufficiently straight (flat) support to prevent buckling of an existing straight (unbuckled) basement wall. However, the force that can be applied by the cantilevered rod and bracket assembly through the I-beam to the wall is significantly limited. Notably, Larsen teaches that the bracing system can also be used to straighten a wall that has already buckled, i.e., further movement of the wall into contact with the I-beam will result in the wall becoming straight again, though inherently inclined. Accordingly, it would be contrary to the teachings of Larsen that his I-beam would be intended or allowed to bend to any significant degree when used to brace a basement wall.

In view of the above, a disadvantage of using an I-beam to brace a masonry wall that has already begun to buckle is that the beam only makes contact with the wall at a single point, corresponding to a tangent of the curvature of the buckled wall. Any further support offered by the beam occurs only after the wall has buckled further, i.e., individual blocks of the wall have moved into contact with portions of the beam not originally contacting the wall. Consequently, the use of an I-beam to brace a buckled masonry wall does not initially stabilize the wall, which can allow significant damage to occur to the wall and the structure supported by the wall. Furthermore, because of the rigidity of an I-beam, over the course of a year gaps can appear where contact between the beam and wall originally existed due to seasonal freezing and thawing. Consequently, to stabilize the wall throughout the year, shims must be installed between the beam and wall to reestablish positive contact therebetween.

In view of the above, what is needed is an improved method of bracing a wall that has already begun to buckle.

SUMMARY OF THE INVENTION

The present invention provides a wall bracing system that uses a beam capable of bending to conform to a masonry wall that has partially buckled inward from external forces, such as hydrostatic pressures to which basement walls are typically exposed. The bracing system of this invention applies a relatively uniform pressure against the wall to prevent further inward movement.

The bracing beam employed by this invention is required to be sufficiently flexible to conform to a partially buckled wall. A preferred beam is an American Standard steel channel having any standard flange width, such that the beam is more readily elastically deformable in a direction perpendicular to its web and opposite the flanges. One end of the beam is secured to the basement floor adjacent the foundation wall, preferably immediately adjacent the wall. The upper end of the beam is held in place with a bracket system bolted to overhead floor joists. The bracket system applies a force against the upper end of the beam toward the wall. Sufficient pressure is applied by the bracket system so that at least that portion of the beam above the point of maximum horizontal wall displacement (e.g., the primary fracture point of the wall), more preferably the entire length of the beam, contacts and conforms to the buckled portion of the wall. As a result, the beam is prestressed when installed, making positive contact with the wall that is not interrupted by any inward or outward movement of the wall. As a result, once installed, the bracing system does not require adjustments or close monitoring. Instead, the prestressed beam moves with the seasonal movement of the walls as temperature and moisture changes occur, while preventing further buckling of the wall.

Other objects and advantages of this invention will be better appreciated from the following detailed description.

DETAILED DESCRIPTION OF THE PREFERRED EMBODIMENT

Figure 1:
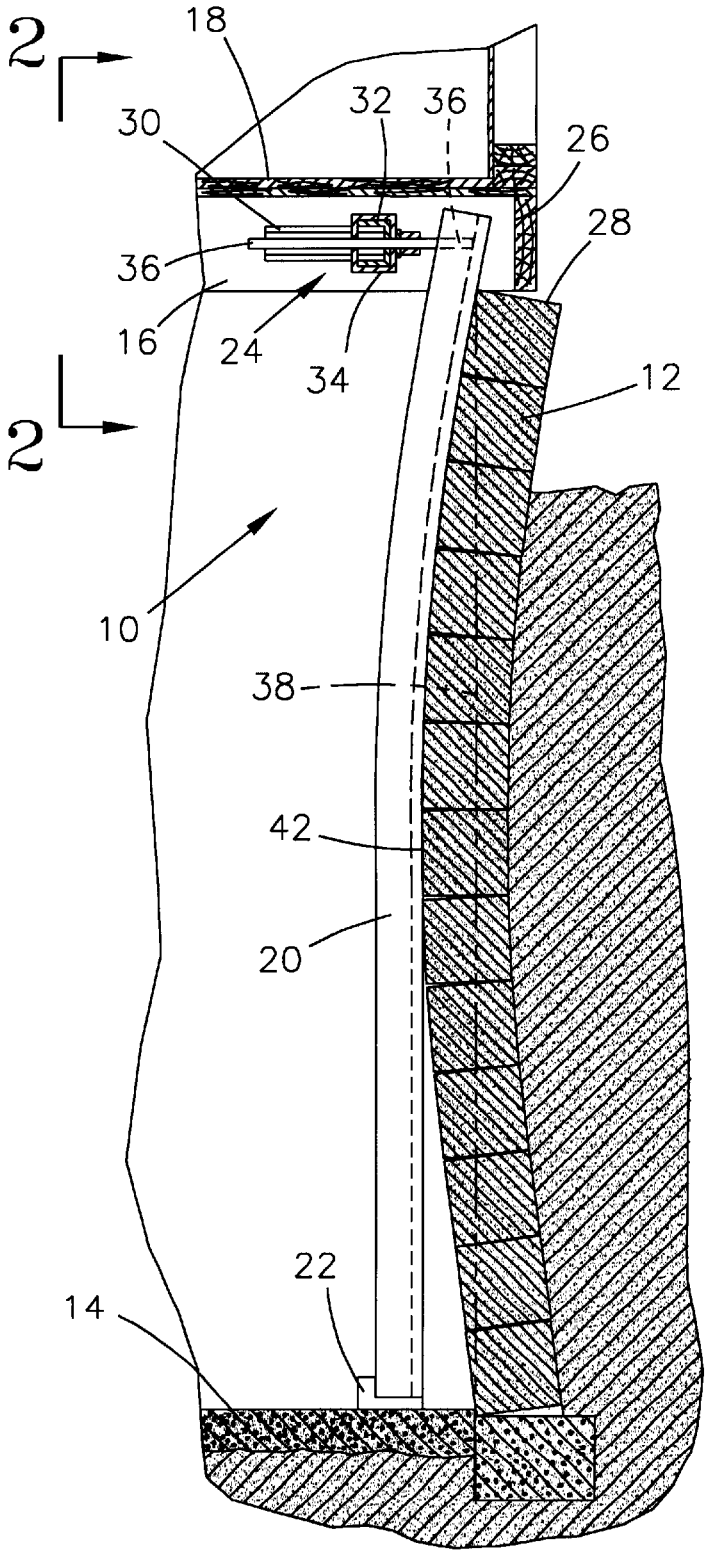
FIG. 1 shows a wall bracing system in accordance with a first embodiment of this invention and installed with a basement masonry wall in a relatively advanced state of buckling.
Figure 4:
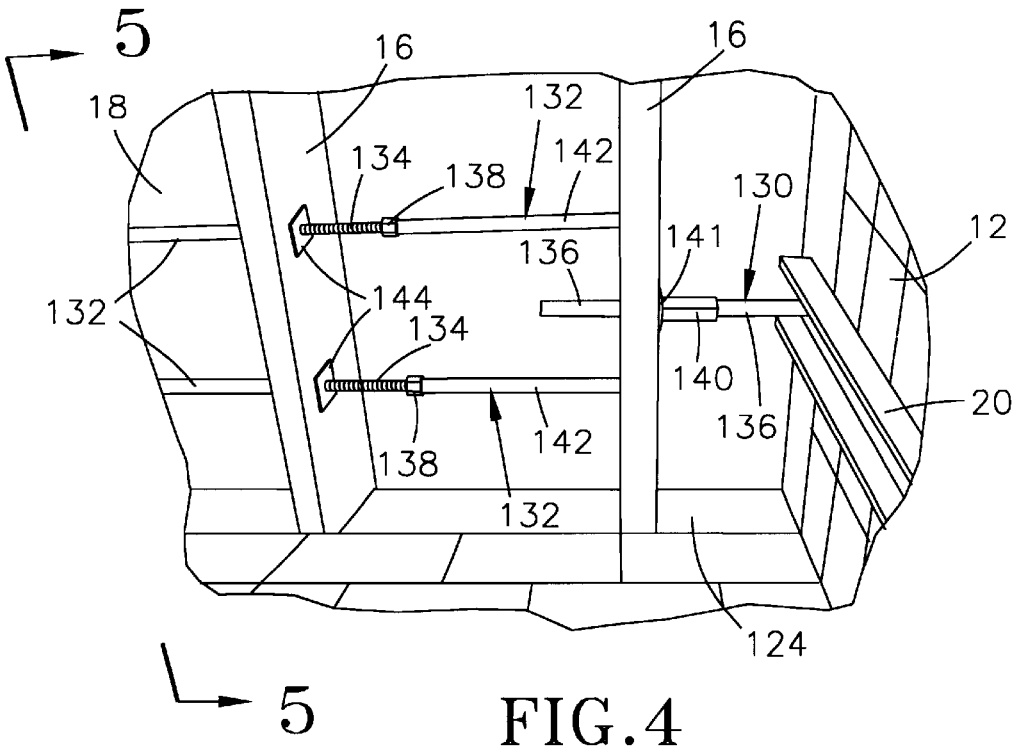
FIGS 4 and 5 show a wall bracing system with a bracket system in accordance with a second embodiment of this invention.

FIGS. 1 and 4 show wall bracing systems 10 and 110 of the present invention. The Figures are all schematic representations of the invention, and therefore are not intended to portray the invention with any accuracy to scale.

The bracing system 10 of FIG. 1 is shown as being installed to support a basement masonry wall 12 that has buckled inward from external hydrostatic pressure and/or other potential causes. The bracing system 10 is shown as including a beam 20 secured with an angle 22 to the basement floor 14 adjacent the wall 12. In FIG. 1, the angle 22 is shown as securing the lower end of the beam 20 a distance from the wall 12, with this distance depicted as being not greater than the distance that the interior surface of the wall 12 has buckled inward from the original position 38 of the wall 12, i.e., the maximum horizontal displacement of a primary fracture point 42 of the wall 12. Consequently, the beam 20 is shown as not contacting a portion of the lower end of the wall 12. However, if the wall 12 is not in an advanced state of buckling, the lower end of the beam 20 is preferably secured immediately adjacent the wall 12 so that essentially the entire length of the beam 20 contacts the wall 12.

The upper end of the beam 20 is engaged by a bracket system 24 secured to floor joists 16 (one of which is visible in FIG. 1) that support a second floor 18. As is conventional, the ends of the floor joists 16 are secured to a sill plate 26 supported on the wall ledge 28. Though a single beam 20 and bracket system 24 are shown, the bracing system 10 of this invention would typically employ multiple sets of the beam 20 and bracket system 24. As is evident from FIG. 1, the beam 20 is elastically deformed by the bracket system 24 so that, other than its lower end, the beam 20 contacts and conforms to the buckled wall 12. As a result, the beam 20 makes continuous and positive contact with all portions of the wall 12 above the primary fracture point 42. In so doing, the beam 20 is stressed, creating a spring tension that continuously and uniformly applies pressure to the wall 12 to prevent further buckling. As noted previously, though FIG. 1 shows the lower end of the beam 20 as being out of contact with the wall 12, under many circumstances the beam 20 is preferably installed to make continuous contact with the entire wall 12, including those portions of the wall 12 below the primary fracture point 42.

The beam 20 is shown as an American Standard channel (i.e., generally C-shaped), preferably a 5 lb. (five pounds per foot; about 7.4 kg/m) channel with a web width of about 3 inches (about 7.5 cm) and flange widths of about 1.5 inches (about 3.8 cm). However, it is foreseeable that other beam configurations could be used if a sufficient degree of bending can be achieved in the manner shown in FIG. 1 to provide adequate and constant support to a buckled wall. The channel beam 20 shown in the Figures is oriented with its web substantially parallel to the wall 12 and its two flanges substantially perpendicular to the wall 12 and facing away from the wall 12. Because the beam 20 is inherently more readily bendable in a direction perpendicular to its web and opposite the flanges than in any other direction, the bracket system 24 is able to conform the beam 20 to the interior surface of the wall 12.

Figure 2:
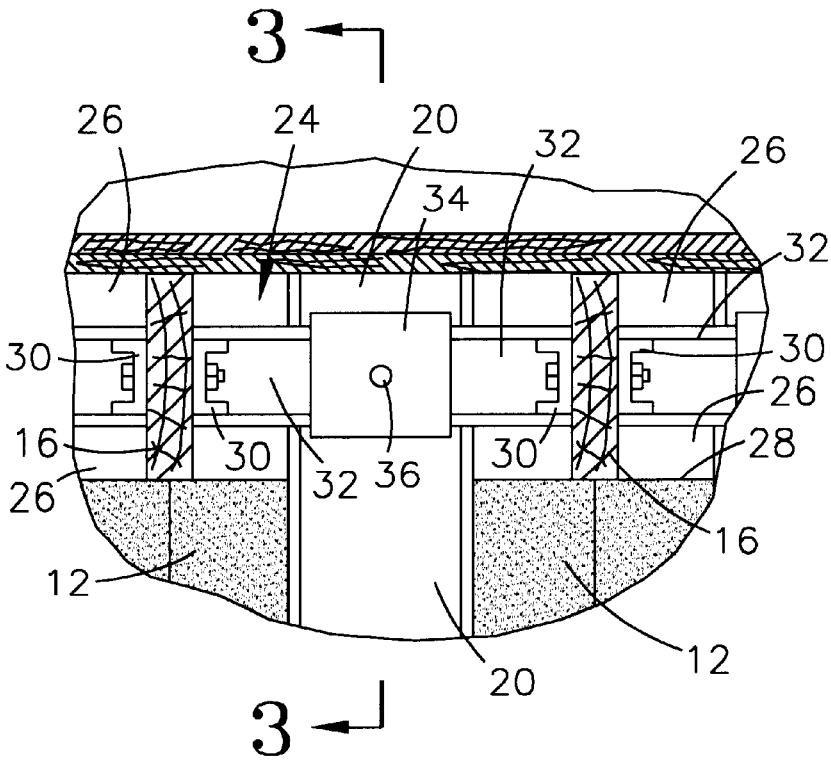
FIG. 2 is a detailed view of a bracket system at the upper end of the bracing system of FIG. 1.
Figure 3:
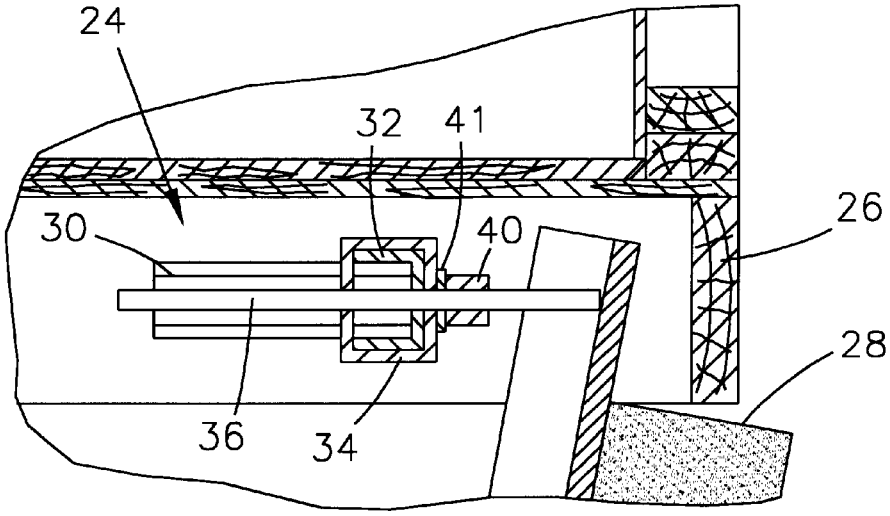
FIG. 3 is a cross-sectional view taken along line 3—3 of FIG. 2.

FIGS. 2 and 3 are detailed views of the bracket system 24 at the upper end of the beam 20. The bracket system 24 is shown secured to and between the floor joists 16 with two channels 30, each of which is preferably fastened with two ½ inch (about 12.7 mm) bolts (not shown). Mounted to the ends of the channels 30 nearest the beam 20 is a cross member 32, shown as being a larger channel with the web and flanges of the smaller channels 30 nested between its flanges. Finally, a hollow section 34 with a rectangular cross-section is preferably fitted around the cross member 32 in the manner shown. The cross member 32 and the hollow section 34 are provided with holes that are aligned to receive a threaded rod 36. The hole in the cross member 32 can be made anywhere along its length in order to avoid obstacles along the wall 12. The hollow section 34 is employed primarily to stabilize the rod 36. A suitable rod 36 has a ¾ inch (about 19 mm) diameter and is used with a 2 inch (about 5 cm) coupling nut 40 and washer 41. With the cross member 32 braced by the ends of the channels 30, the end of the rod 36 is abutted against the upper end of the beam 20, after which the coupling nut 40 is tightened to drive the threaded rod 36 against the beam 20, causing the beam 20 to become deformed to match the contour of the buckled wall 12 as shown in FIG. 1.

The bracket system 24 of FIGS. 1 through 3 is secured to two floor joists 16, with the load generated by the bracket system 24 typically being uniformly distributed to both joists 16. The ability of the bracing system 10 to safely support a buckled wall 12 has been demonstrated through typical basement installations. In one such installation, the force required of the bracket system 24 to support and stabilize a masonry wall that had buckled inward about 2.5 inches (about 6.35 cm) at the wall midpoint was calculated to be about 3000 lbs. force (about 13 kN). The ability of the bracket system 124 to safely generate the required load was proven in laboratory testing, in which the bracket system 24 as described above was able to generate a load of 9000 lbs. force (about 40 kN), from which the cross member 32 developed a permanent set of about 1.25 inches (about 3 cm) without any failure of the bracket system 24 or the floor joists to which the channels 30 were secured.

Figure 5:
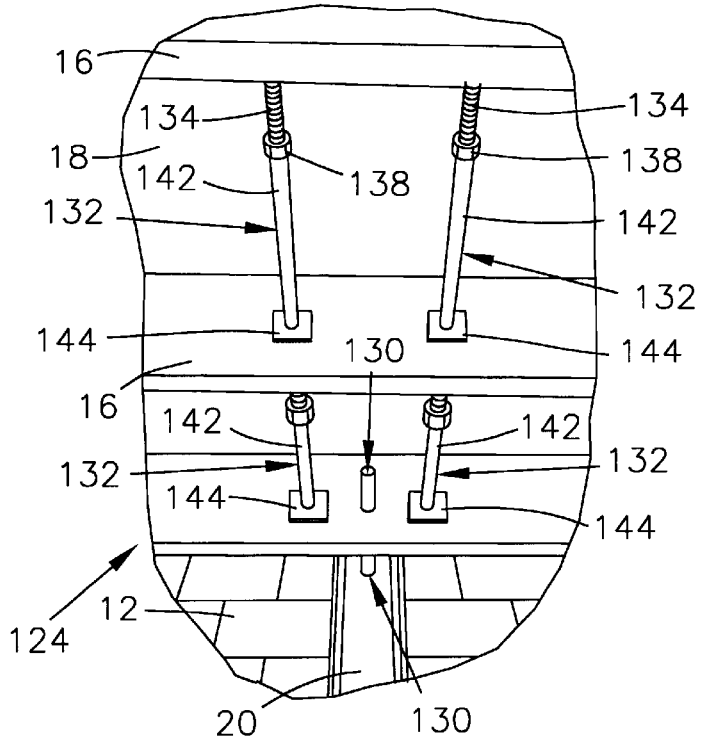

The bracing system 110 of FIGS. 4 and 5 differs from FIGS. 1 through 3 only by the bracket system 124 used (consequently, like features in FIGS. 1 through 5 are identified by the same reference numbers). As with the bracket system 24 of the first embodiment, the bracket system 124 of FIGS. 4 and 5 engages the upper end of the beam 20, deforming the beam 20 so that the beam 20 contacts and conforms to the buckled wall 12. The bracket system 124 differs from that of the first embodiment by the use of multiple adjustable joist supports 130 and 132. A first support 130 comprises a threaded rod 136 and a threaded coupling nut 140 and washer 141. One end of the rod 136 is received in a hole in the joist 16 nearest the wall 12, while the opposite end of the rod 136 is abutted against the upper end of the beam 20. The coupling nut 140 is tightened to drive the threaded rod 136 against the beam 20, causing the beam 20 to become deformed to match the contour of the buckled wall 12 as described previously. The remaining joist supports 132 are shown as being secured to and between adjacent floor joists 16 further back from the joist 16 to which the first support 130 is secured. Each support 132 comprises a threaded rod 134, a threaded nut 138, and a tube 142 in which one end of the rod 134 is received. The nut 138 of each support 132 is tightened to drive its respective rod 134 against the facing joist 16, such that all of the joists 16 are limited in the degree to which they are able to flex under the load generated by the beam 20 on the first support 130. The oppositely-disposed ends of the rod 134 and tube 142 of the supports 132 are shown as being equipped with flanges 144 that distribute the load at the joists 16.

In view of the invention as described above, the bracing systems 10 and 110 are not intended to prevent bowing of a straight masonry wall. Instead, the bracing systems 10 and 110 prevent an existing bowed wall from further deformation and cave-in. The beam 20 is prestressed and molded to conform to the bow in the wall 12, thereby providing greater and more uniform contact with the wall 12 and distributing the bracing force more effectively. Once installed, further adjustments are not necessary as the flexed beam 20 is able to continuously adapt to changing conditions, including variations in external wall pressure caused by seasonal changes.

The bracing systems 10 and 110 of this invention are much more versatile than prior art wall bracing systems, due in part to the ability to locate the threaded rods 36 and 136 anywhere along the wall 12. Another important advantage is that, because the entire installation is internal to the wall 12, the bracing system 20 can be installed any time of year without exterior excavation so as to avoid damage to landscaping, driveways and patios, and does not require drilling holes through the wall 12 that would otherwise contribute to seepage. Because the bracing systems 10 and 100 do not require periodic adjustment or shimming, the supported wall 12 can be immediately paneled or otherwise finished to conceal the beam 20. Yet another advantage is that the entire installation can be performed with common tools.

While the invention has been described in terms of a preferred embodiment, it is apparent that other forms could be adopted by one skilled in the art. For example, the system 10 could differ in appearance and construction from the embodiment shown in the Figures, and appropriate materials could be substituted for those noted. Accordingly, the scope of the invention is to be limited only by the following claims.

What is claimed is:

1. A wall bracing system installed with a basement masonry wall that is adjacent a basement floor, supports at least one floor joist and a floor of a building, and has buckled inward from external forces so that an interior surface of the wall has a horizontal displacement point, the wall bracing system comprising:

a beam elastically deformed to make continuous contact with and apply pressure against the horizontal displacement point of the wall and at least an adjacent portion of the interior surface of the wall so as to inhibit further inward movement of the horizontal displacement point and the adjacent portion though the wall remains buckled;

means for securing a lower end of the beam adjacent the wall; and means for securing an upper end of the beam to the at least one floor joist, the upper securing means being operative to apply a sufficient force against the upper end of the beam toward the wall to elastically deform the beam against the interior surface of the wall while the lower end of the beam remains secured adjacent the wall.

2. A wall bracing system according to claim 1, wherein the upper securing means comprises a threaded rod, a threaded coupling threadably engaged with the threaded rod, and means for transmitting a force generated by the threaded rod and the threaded coupling to the at least one floor joist.

3. A wall bracing system according to claim 1, wherein the upper securing means comprises first and second channel members secured to respective adjacent floor joists and having ends adjacent the wall, a cross member abutted against the ends of the first and second channel members such that the cross member is positioned between the floor joists, a hollow member surrounding the cross member, the cross member and the hollow member having aligned through-holes, a threaded rod received in the through-holes of the cross member and the hollow member, and means for transmitting a force through the threaded rod to the floor joists.

4. A wall bracing system according to claim 1, wherein the upper securing means comprises a threaded rod and means for transmitting a force generated by the threaded rod to the at least one floor joist, the upper securing means further comprising multiple supporting means for transmitting a force between the at least one floor joist and a second floor joist.

5. A wall bracing system according to claim 1, wherein the beam is a channel having a web and two flanges along opposite sides of the web, the beam being more readily elastically deformable in a direction perpendicular to the web and opposite the flanges.

6. A wall bracing system according to claim 5, wherein the beam has a mass per unit length of about five pounds per foot, the web has a width of about 3 inches, and each of the flanges has a width of about 1.5 inches.

7. A wall bracing system according to claim 1, wherein the horizontal displacement point is a maximum horizontal displacement point of the wall, and the adjacent portion of the interior surface of the wall is above the maximum horizontal displacement point.

8. A wall bracing system according to claim 7, wherein the lower securing means secures the lower end of the beam from the wall a distance less than or equal to the horizontal displacement of the maximum horizontal displacement point of the wall.

9. A wall bracing system according to claim 8, wherein the lower securing means secures the lower end of the beam adjacent the wall so that the upper securing means causes the beam to be elastically deformed above and below the maximum horizontal displacement point of the wall.

10. A wall bracing system according to claim 7, wherein the upper securing means comprises a cross member having a through-hole, means securing the cross member between and to at least two floor joists, a threaded rod received in the through-hole of the cross member and having one end abutting the beam, and a threaded coupling threadably engaged with the threaded rod and abutting the cross member.

11. A wall bracing system according to claim 7, wherein the at least one floor joist is parallel to the wall and additional parallel floor joists are spaced further from the wall than the at least one floor joist, and wherein the upper securing means comprises a threaded rod received in a through-hole in the at least one floor joist and having one end abutting the beam, and a threaded coupling threadably engaged with the threaded rod, the upper securing means further comprising multiple supporting means, each supporting means being between and engaged with at least two floor joists of the additional parallel floor joists.

12. A wall bracing system according to claim 7, wherein the beam is a C-shaped channel having a web parallel to the wall and two flanges along opposite sides of the web and perpendicular to the wall.

13. A wall bracing system installed with a basement masonry wall that is adjacent a basement floor, supports at least one floor joist and a floor of a building, and has buckled inward from external forces so that an interior surface of the wall has a maximum horizontal displacement point, the wall bracing system comprising:

a beam elastically deformed to conform to and apply a uniform pressure against at least a portion of the wall above the maximum horizontal displacement point of the wall so as to prevent further inward movement of the wall, the beam being a C-shaped channel having a web parallel to the wall and two flanges along opposite sides of the web and perpendicular to the wall;

means securing a lower end of the beam adjacent the wall;

means securing an upper end of the beam to the at least one floor joist, the upper securing means applying a sufficient force against the upper end of the beam toward the wall to elastically deform the beam at least above the maximum horizontal displacement point of the wall while the lower end of the beam remains secured adjacent the wall, the upper securing means allowing the beam to move with seasonal movement of the wall as temperature and moisture changes occur while preventing further buckling of the wall.

14. A wall bracing system according to claim 13, wherein the lower securing means secures the lower end of the beam adjacent the wall so that the upper securing means causes the beam to be elastically deformed above and below the maximum horizontal displacement point of the wall.

15. A method of bracing a basement masonry wall that is adjacent a basement floor, supports at least one floor joist and a floor of a building, and has buckled inward from external forces so that an interior surface of the wall has a horizontal displacement point, the method comprising the steps of:

securing a lower end of a beam adjacent the wall; and then securing an upper end of the beam to the at least one floor joist and applying a sufficient force against the upper end of the beam toward the wall to elastically deform the beam against the interior surface of the wall while the lower end of the beam remains secured adjacent the wall so that the beam makes continuous contact with and applies pressure against the horizontal displacement point of the wall and at least an adjacent portion of the interior surface of the wall, the beam inhibiting further inward movement of the horizontal displacement point and the adjacent portion though the wall remains buckled.

16. A method according to claim 15, wherein the upper end of the beam is secured by threadably engaging a threaded rod with a threaded coupling and transmitting a force generated by the threaded rod and the threaded coupling to the at least one floor joist.

17. A method according to claim 15, wherein the upper end of the beam is secured by securing first and second channel members to respective adjacent floor joists so as to have ends adjacent the wall, surrounding a cross member with a hollow member, abutting the cross member against the ends of the first and second channel members such that the cross member is positioned between the floor joists, placing a threaded rod in aligned through-holes of the cross member and the hollow member so that one end of the threaded rod abuts the beam, and threadably engaging the threaded rod with a threaded coupling that abuts the hollow member and transmits a force through the threaded rod to the floor joists.

18. A method according to claim 15, wherein the at least one floor joist is parallel to the wall and additional parallel floor joists are spaced further from the wall than the at least one floor joist, wherein the upper end of the beam is secured by threadably inserting a threaded rod in a through-hole in the at least one floor joist, abutting one end of the threaded rod against the beam, threading a threaded coupling on the threaded rod to abut the at least one floor joist, and providing multiple supporting means between and engaged with at least two floor joists of the additional parallel floor joists to transmit a force between the at least one floor joist and the at least two floor joists.

19. A method according to claim 15, wherein the beam is a channel having a web and two flanges along opposite sides of the web, the beam being more readily elastically deformable in a direction perpendicular to the web and opposite the flanges.

20. A method according to claim 15, wherein the beam is a C-shaped channel having a web parallel to the wall and two flanges along opposite sides of the web and perpendicular to the wall.

21. A method according to claim 20, wherein the beam has a mass per unit length of about five pounds per foot, the web has a width of about 3 inches, and each of the flanges has a width of about 1.5 inches.

22. A method according to claim 15, wherein the horizontal displacement point of the interior surface of the wall is a maximum horizontal displacement point and the adjacent portion of the interior surface of the wall is above the maximum horizontal displacement point, and wherein the lower end of the beam is secured from the wall a distance less than or equal to the horizontal displacement of the maximum horizontal displacement point of the wall.

23. A method according to claim 22, wherein the lower end of the beam is secured adjacent the wall so that the beam is elastically deformed above and below the maximum horizontal displacement point of the wall.

24. A wall bracing system for a basement masonry wall that is adjacent a basement floor, supports at least one floor joist and a floor of a building, and has buckled inward from external forces, the wall bracing system comprising:

a beam deformable to conform to and apply pressure against at least a portion of an interior surface of the wall so as to inhibit further inward movement of the wall, the beam being more readily elastically deformable in a direction perpendicular to the wall than in a direction parallel to the wall;

means for securing a lower end of the beam adjacent the wall; and means for securing an upper end of the beam to the at least one floor joist, the upper securing means being operative to apply a sufficient force against the upper end of the beam toward the wall to elastically deform the beam against the interior surface of the wall while the lower end of the beam remains secured adjacent the wall.

25. A wall bracing system according to claim 24, wherein the beam is a channel having a web and two flanges along opposite sides of the web so that the beam is more readily elastically deformable in a direction perpendicular to the web and opposite the flanges.

* * * * *